US007870643B2

(12) United States Patent
Krueger et al.

(10) Patent No.: US 7,870,643 B2
(45) Date of Patent: Jan. 18, 2011

(54) HINGE ARRANGEMENT FOR A TAILGATE OF A MOTOR VEHICLE

(75) Inventors: Norbert Krueger, Essen (DE); Christian Kaczmarczyk, Velbert (DE)

(73) Assignee: Witte-Velbert GmbH & Co. KG (DE)

( * ) Notice: Subject to any disclaimer, the term of this patent is extended or adjusted under 35 U.S.C. 154(b) by 463 days.

(21) Appl. No.: 11/950,746

(22) Filed: Dec. 5, 2007

(65) Prior Publication Data

US 2009/0260186 A1 Oct. 22, 2009

(30) Foreign Application Priority Data

Dec. 9, 2006 (DE) ..... 10 2006 058 138

(51) Int. Cl.
*E05F 1/14* (2006.01)

(52) U.S. Cl. ..... 16/282; 16/85; 296/56; 296/146.8

(58) Field of Classification Search ..... 16/277, 16/297, 298, 387, 343; 296/146.11, 146.12, 296/146.8, 146.9, 76
See application file for complete search history.

(56) References Cited

U.S. PATENT DOCUMENTS 6,341,809 B1 * 1/2002 Chapman ..... 296/56
6,418,667 B1 * 7/2002 Moon ..... 49/340
6,533,342 B2 * 3/2003 Auer et al. ..... 296/76
6,550,839 B2 * 4/2003 Rogers et al. ..... 296/56
7,308,732 B2 * 12/2007 Woolcock ..... 16/240

* cited by examiner

*Primary Examiner*—William L. Miller
(74) *Attorney, Agent, or Firm*—St. Onge Steward Johnston & Reens LLC

(57) ABSTRACT

The invention relates to a hinge arrangement, in particular for a tailgate of a motor vehicle, having a first hinge part, in particular firmly connected to the body, which is knuckle-jointed with a second hinge part, and having an energy accumulator, the force application points of which are positioned in relation to both hinge parts in such a way that the force released upon its discharge supports the rotation of the two hinge parts around the hinge axis from a first rotation position, which corresponds in particular to a closed position of the tailgate, to a second rotation position, which corresponds in particular to the open position of the tailgate. To obtain useful improvements, a transposition device is proposed for transposing at least one force application point in one of the two rotation positions, so that after a transposition onto the hinge parts a force acts in the opposite rotation direction.

9 Claims, 2 Drawing Sheets

HINGE ARRANGEMENT FOR A TAILGATE OF A MOTOR VEHICLE

CROSS-REFERENCE TO RELATED APPLICATIONS

The present application claims priority of German patent application No. 10 2006 058 138.5 filed on Dec. 9, 2006, the content of which is incorporated herein by reference.

FIELD OF THE INVENTION

The invention relates to a hinge arrangement, in particular for a tailgate of a motor vehicle, having a first hinge part, in particular firmly connected to the body, which is knuckle-jointed with a second hinge part, and having an energy accumulator, the force application points of which are positioned in relation to both hinge parts in such a way that the force released upon its discharge supports the rotation of the two hinge parts around the hinge axis from a first rotation position, which corresponds in particular to a closed position of the tailgate, to a second rotation position, which corresponds in particular to the open position of the tailgate.

BACKGROUND OF THE INVENTION

A hinge arrangement of this type is known in the art. Tailgate hinges have two hinge parts. A first hinge part is firmly mounted to the vehicle body. A second hinge part sits on the gate. In addition, a gas pressure spring grips the gate with one force application point. The other end of the gas pressure spring is affixed to the body. The force application points of the gas pressure spring are positioned in relation to the two hinge parts in such a way that upon opening the lock that holds the tailgate in the closed position, the force of the discharging gas pressure spring supports the opening of the gate and thus the rotation of the two hinge parts. The gas pressure spring, in addition, holds the gate in the open position. The gas pressure spring is a cushioned spring. This results in a slow de-tensing of the energy accumulator. To close the tailgate again, the force of the gas pressure spring must be overcome manually. In the course of closing, the gas pressure spring is tensed again.

SUMMARY OF THE INVENTION

It is the object of the invention to perfect the aforementioned hinge arrangement in a user-friendly manner.

This object is realized by the invention as indicated in the claims, wherein every claim constitutes an independent solution of the invention and can be combined with every other claim.

The inventive solution results in a mechanism for a tailgate that is simple in configuration and economical to produce.

First, and most essentially, a transposition device is provided for transposing at least one power application point in one of the two rotation positions. During transposition of the power application point, the energy direction of the energy accumulator to the opposite rotation direction. The energy accumulator can consist of a spring. Both application points can be displaced during the transposition. An energy accumulator may also consist of two or more springs. It is sufficient if just one power application point is transposed. In a preferred embodiment of the invention, the two hinge parts are affixed in the rotation position by a lock. The transposition takes place while the rotation is in affixed position. The transposition of the at least one power application point takes place preferably with the hinge parts in both rotation positions. In a hinge arrangement positioned on a motor vehicle, a first transposition takes place after opening the tailgate. This transposition occurs in the resting position in which the two hinge parts are held by a lock that can preferably also be counteracted manually. During the transposition, at least one spring element of the energy accumulator is tensed. In coordination with this, the power effect of the energy accumulator on the hinge part changes. In the course of the transposition it is pressured in the opposite direction. In the tailgate of a motor vehicle, the manual or eletromechanical counteraction of the lock has the effect that the gate is independently closed through the de-tensing energy accumulator. Here too, a cushioning element can act between the two hinge parts so that both the opening and the closing of the tailgate occur with cushioning. The energy accumulator preferably consists of several springs. The sum of the aimed individual forces is then the force effect of the energy accumulator that acts on the hinge parts. The force application points are not required to be bodily seated on the individual hinge parts. They can be positioned on the body or the tailgate even at a distance from the hinge parts. What is essential, however, is a positioning of the force application points to the hinge parts in such a way that the energy accumulator opens tailgate in a first operating position and closes the tailgate in a second operating position, and thus the transfer between the two operating positions occurs with the two hinge parts in a fixed rotation position. The two hinge parts are affixed by means of said lock, which can take the form of a bolt lock, which uses one lock shoulder to support a lock stage of the other hinge part. With the tailgate in the closed position, the two hinge parts are usually affixed to one another by a closed tailgate lock. The transposition device is preferably powered by an electrical engine. This engine is set in operation as soon as the rotation end switch detects one of the two rotation end positions of the two hinge parts. Then the electrical engine powers a gear wheel reduction, preferably by means of a drive worm. This gear wheel reduction acts on a gear lever. Said gear lever can consist of a rotation lever on whose free end the force application point of one of the springs rests. The transposition preferably occurs through standstill position, so that the end position of the transposition device is affixed by means of a stop. It is possible to provide two stops, which are alternatingly impacted by a draw spring associated with the energy accumulator. Consequently, with the transposition device in the end positions, no holding force acts on the electrical engine. With a tailgate operation of this configuration, no clamping protection is necessary because the opening movement and the closing movement can be interrupted at any time. Opening and closing movements in each case are powered only by de-tensing springs. In a preferred variant of the invention, only one spring of the energy accumulator consisting of several springs is transposed. A first spring causes the rotation displacement into the one direction, or into the opening position of the tailgate. Here both energy accumulator springs can be de-tensed. After reaching the rotation end position, that is, the open position of the tailgate and the unlocking of the two hinge parts, only one spring, preferably the stronger one, is transposed and in the process de-tensed. The tensing force of the spring is greater than the force of the spring that deploys the opening effect, so that this spring is again tensed by the force of the other spring I the course of the closing of the tailgate. The transposition occurs along with a loading of the energy accumulator.

One embodiment of the invention is explained hereafter with reference to the appended illustrations.

DETAILED DESCRIPTION OF THE INVENTION

Figure 1:
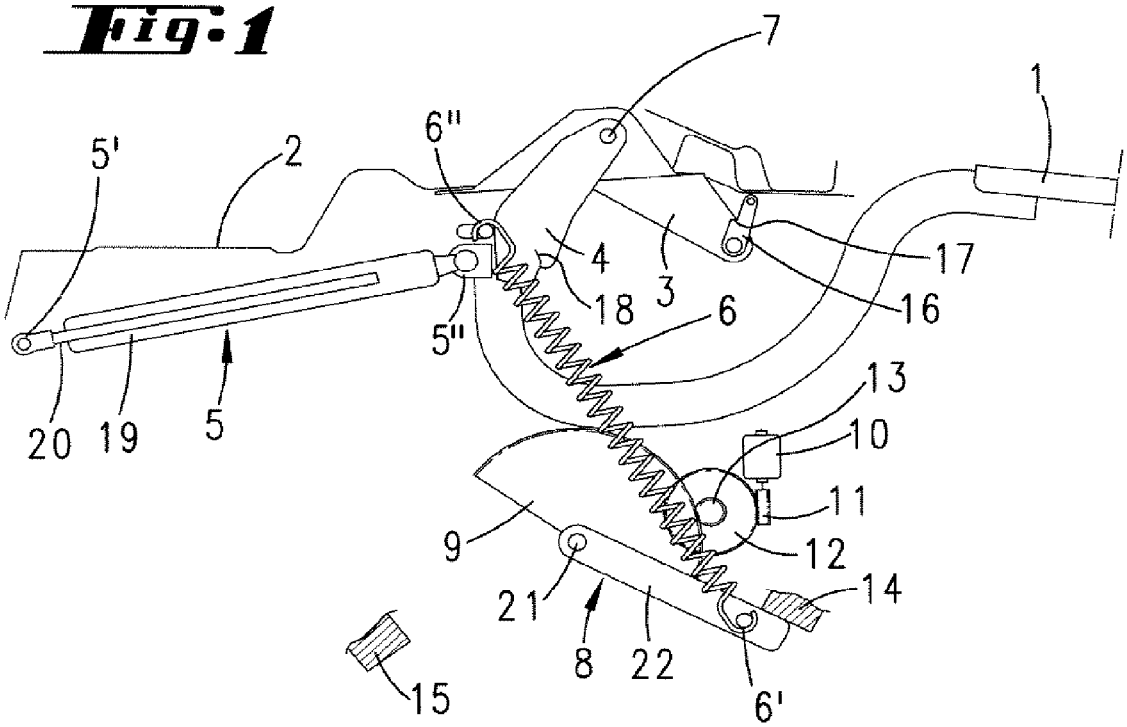
FIG. 1 shows in a schematic view the essential elements of the hinge arrangement with the tailgate in the closed position.
Figure 2:
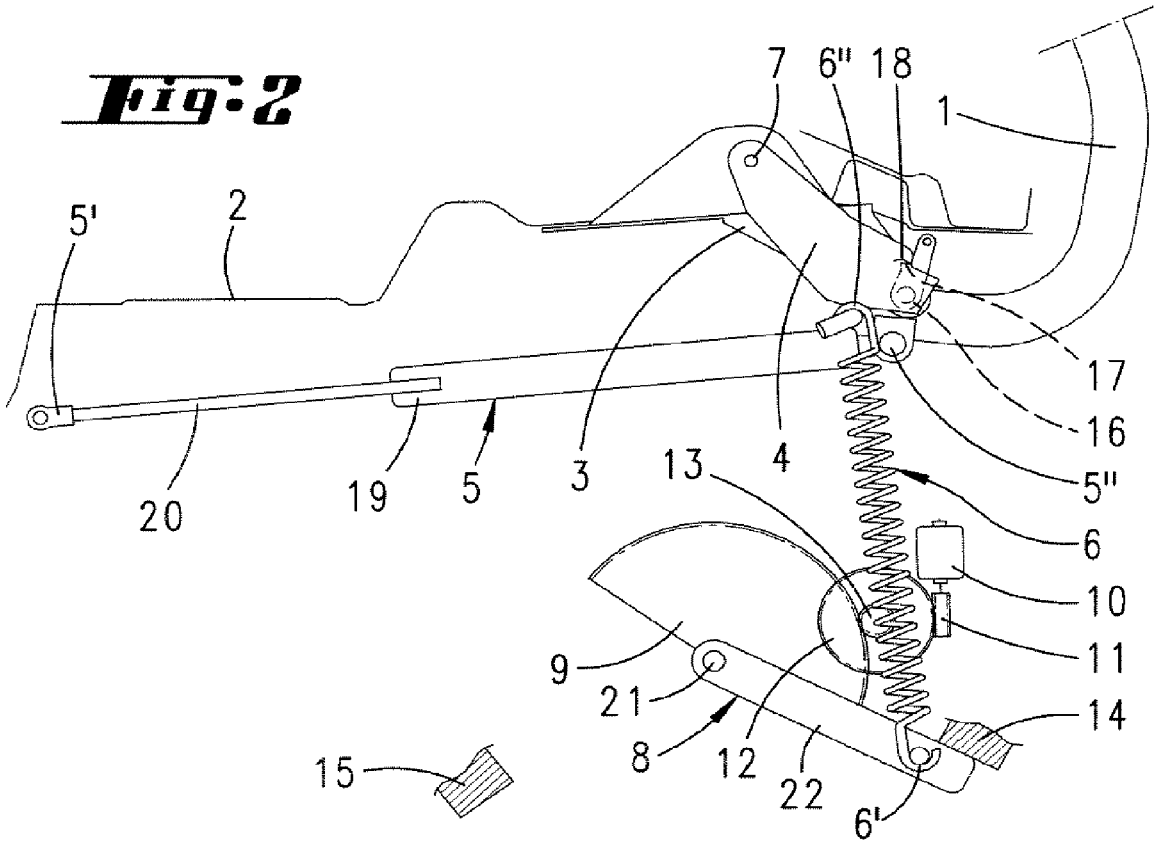
FIG. 2 shows the opened gate after de-tensing of the energy accumulator.
Figure 3:
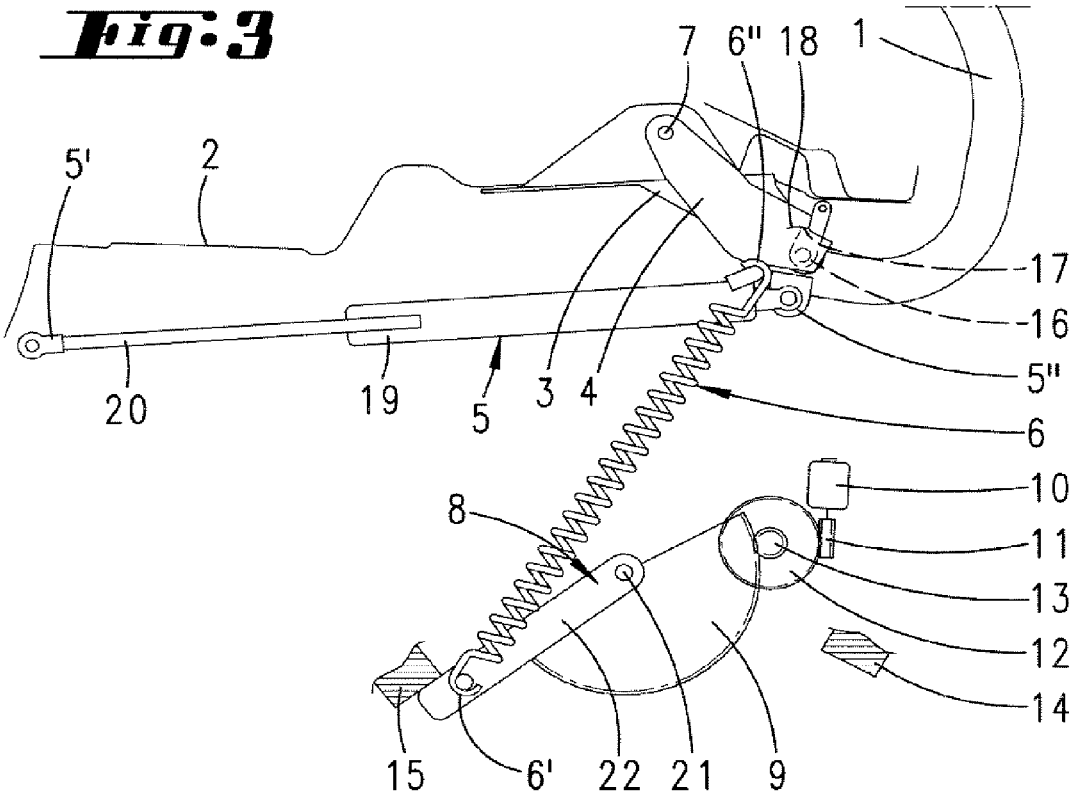
FIG. 3 shows the opened tailgate with the energy accumulator tensed in the opposite direction.
Figure 4:
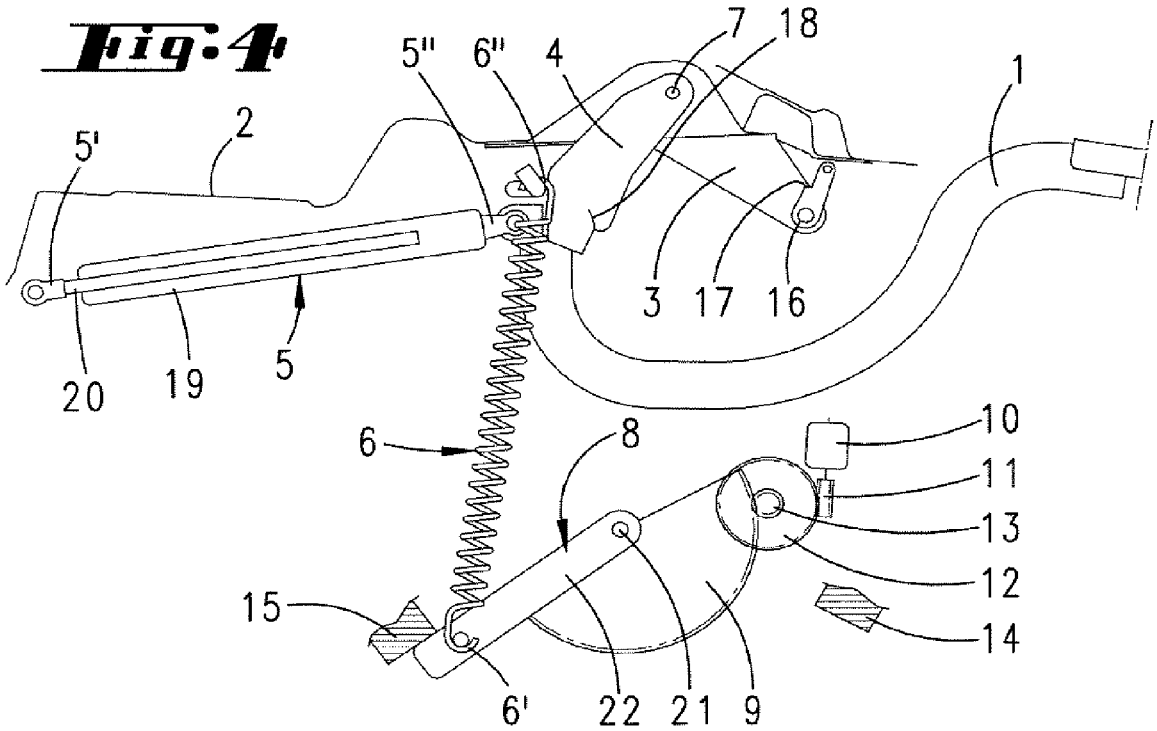
FIG. 4 shows the closed position of the tailgate with the energy accumulator de-tensing.

The hinges is firmly connected with a vehicle body 2 by means of a first hinge part 3. A second hinge part 4 is hinged onto the first hinge part 3. The two hinge parts 3, 4 can rotate with respect to one another around the gear axis 7. The hinge part 4 is firmly connected with a tailgate 1. A first rotation end position, which is shown in FIGS. 1 and 4, corresponds to the closed position of the tailgate 1. A second rotation position, which is shown in FIGS. 2 and 3, corresponds to the open position of the tailgate.

The body 2 bears a transposition device 8. This transposition device 8 has an electrical engine 10, whose output shaft powers a worm wheel 11. The worm wheel 11 engages in the teeth of a transmission wheel 12. Said wheel interacts with gear wheel 13 that has a lesser diameter and that interlocks with the teeth of a toothed segment 9, which can turn around a rotation axis 21. The toothed segment 9 bears a lever 22. The lever 22 can rotate around the rotation axis 21 together with the toothed segment 9. The other, free end of the lever 22 bears a pin around which one end of a draw spring 6 is tensed. This pin forms a force application point 6' of the draw spring 6. The force application point 6" associated with the other end of the draw spring 6 is also configured by a pin, which is associated with the second, non-movable hinge part 4.

In proximity to the force application point 6" of the draw spring 6, another force application point 5" of a gas pressure spring 5 is affixed to the second hinge part 4. The gas pressure spring 5 is a cushioning element. The force application point 5' opposite the force application point 5" is affixed firmly to the body 2. The operating directions of the two springs 5,6 are separate from one another. One of the two springs 5 is a pressure spring while the other spring 6 is a draw spring.

By rotating the lever 22, the fore application point 6' of the draw spring 6 can be displaced. In both end positions of the lever 22, the lever is situated before a stop 14, 15. Both in the stop position shown in FIGS. 1 and 2 and in the stop position of FIGS. 3 and 4, the draw spring 6 is at an acute angle to the extension direction of the lever 22, so that the draw spring 6 holds the lever 22 against the respective stop 14, 15 by exerted force. In displacing the transposition device 8, that is, in rotating the lever 22 around the rotation axis 21, the draw spring 6 is tensed and counteracts a standstill position.

The hinge part 3 firmly attached to the body bears a locking lever 16, which can be rotated by an electromechanical drive (not illustrated). The locking lever 16 has a lock shoulder 17, before which there is a lock stage 18 of the second hinge part 4, with the tailgate 1 (FIGS. 2 and 3) in the open position. The hinge parts 3,4 in this position are coupled to one another and locked against rotation. In order to rotate the hinge parts 3, 4 with respect to one another starting from the locking position shown in FIGS. 2 and 3, the lock must be released. This can occur, on the one hand, by a rotation of the lock lever 16 or, on the other hand, by applying a rotating force on the tailgate 1. Then the lock shoulder 17 emerges independently under the lock stage 18. This can occur contrary to the return force of a lock lever spring (not illustrated).

In the operating position shown in FIG. 1, the gas pressure spring 5 is tensed. At the force application point 5" a force acts on the second hinge part 4, which is secure against opening. The draw spring 6, which in this operating position assumes an obtuse angle to the gas pressure spring 5, a low draw force is exerted on the force application point 6. Both forces act on the second hinge part 4 in such a way that, after opening a gate lock (not illustrated), it rotates into the rotation end position shown in FIG. 2. In this rotation end position the draw spring 6 is essentially released, or has a minimal tensing force. The same is true for the gas pressure spring 5. It is de-tensed against a stop position. In the position shown in FIG. 2 the lock shoulder 17 of the locking lever 16 is below the lock stage 18.

By means of micro-switches that are not illustrated here, the internal electronics or internal computer recognizes the rotation end position of the two hinge parts 3, 4. Thereupon the internal electronics sets the drive engine 10 in operation. The lever 22 is rotated by means of the previously described gear reduction. This occurs together with a tensing of the draw spring 6 until it passes a stillstand position that is to be counteracted against the stop 15 shortly before reaching the stop position. In the operating position shown in FIG. 3, the draw spring 6 is tensed. The tensing force of the draw spring 6 is greater than the pressure force of the gas pressure spring 5 but smaller than the locking force of the lock 17, 18. The fixing of the two hinge parts 3, 4 is released by electromechanical rotation of the locking lever 16 or by counteracting the lock 17, 18 by exerting a rotation force o the gate 1. The result is that the force impact of the draw spring 6 can be released onto the second hinge part 4. Acting together with a tensing of the gas pressure spring 5, the draw spring 6 is shortened and rotates the gate 1 until it reaches the locked position shown in FIG. 4. In this position too, the force of the de-tensed draw spring 6 is greater than the force of the tensed gas pressure spring 5.

Both the rotation from the locked position of the gate shown in FIG. 1 into the open position shown in FIG. 2 and from the open position of the gate shown in FIG. 3 into the closed position shown in FIG. 4 are cushioned by means of the cushioning effect of the gas pressure spring 5. The closing movement and also the opening movement of the tailgate 1 can be interrupted at any time. This requires only the counteracting of the currently acting force of the energy accumulator consisting of the two springs 5, 6. Here the gate 1 can also be displaced against the force impact of the spring back into the starting position, that is, or else back into the open position shown in FIG. 3 or back into the closed position shown in FIG. 1.

After a closing movement of the tailgate 1 caused by an energy accumulator de-tensing from the open position shown in FIG. 3 into the closed position shown in FIG. 4, the non-illustrated tailgate lock closes and fixes the two hinge parts 3, 4 in this rotation end position. In connection with this, the new operating condition of the tailgate 1 is transmitted to the internal electronics by way of a micro-switch. The internal electronics then actuates a transposition of the force application point 6' of the draw spring 6. The power engine 10 is set in operation in the opposite direction and transmits its rotary movement to the toothed segment 9. The lever 22 is released from the stop 22 and tenses and rotates the draw spring 6 into the operating position shown in FIG. 1, so that also here, shortly before reaching the stopping position against the stop

14, a stillstand position is exceeded. Because the gas pressure spring has already been tensed during the closing of the tailgate by the draw spring 6 that is being de-tensed, in the displacement from the operating position shown in FIG. 4 into the operating position shown in FIG. 1, no great tensing of the draw spring 6 is necessary.

In embodiments that are not illustrated, additional force application points s5', 5", 6" are displaced. In another not illustrated embodiment, the energy accumulator has only a single spring, which is transposed in each case in the resting position of the hinge parts 3, 4, in which it is immobilized, so that the force impact on the hinge parts 3, 4 is modified.

All described characteristics are (in themselves) essential parts of the invention. The publication of the application hereby also includes in full the descriptive content of the associated/enclosed priority documents (copy of the application), for the additional purpose of including characteristics of these documents in the claims of the present application.

What is claimed is:

1. A hinge arrangement, of a tailgate of a motor vehicle, having a first hinge part, firmly connected to a body, which is knuckle-jointed with a second hinge part, and having an energy accumulator, connectable to the first hinge part and the second hinge part, the energy accumulator having a plurality of force application points of which are positioned in relation to both hinge parts in such a way that the force released upon its discharge supports the rotation of the two hinge parts around a hinge axis from a first rotation position, which corresponds to a closed position of the tailgate, to a second rotation position, which corresponds to an open position of the tailgate, characterized by a transposition device for transposing at least one of the force application points to one of the two rotation positions in such a way that, after transposition a force acts on the hinge parts in the opposite rotation direction.

2. A hinge arrangement as set forth in claim 1, characterized by one of the two hinge parts being held in either of the rotation positions by a lock during the transposition of the at least one force application point.

3. A hinge arrangement as set forth in claim 2, wherein a locking force is greater than the force of the energy accumulator acting on the hinge parts after transposition.

4. A hinge arrangement as set forth in claim 3, wherein the locking force can be manually counteracted.

5. A hinge arrangement as set forth in claim 1, wherein the energy accumulator includes a plurality of springs with a plurality of related force application points.

6. A hinge arrangement as set forth in claim 1, wherein the energy accumulator includes a cushioning element.

7. A hinge arrangement as set forth in claim 1, wherein the transposition device is powered by an electrical engine which during transposition tenses a spring of the energy accumulator.

8. A hinge arrangement as set forth in claim 1, wherein the transposition device includes a gear lever.

9. A hinge arrangement as set forth in claim 1, wherein the transposition device, which is controlled by a sensor after reaching one of two rotation end positions of the two hinge parts, displaces at least one force application point of the energy accumulator in such a way that the force acting on the hinge parts reverses direction, so that the two hinge parts in the two rotation end positions is each secured in position by means of a lock or holding device.

* * * * *